US005680786A

United States Patent [19]

Lee, Jr.

[11] Patent Number: 5,680,786

[45] Date of Patent: Oct. 28, 1997

[54] STOP RING IN APPARATUS FOR FLANGING CONTAINERS

[75] Inventor: Harry W. Lee, Jr., Chesterfield County, Va.

[73] Assignee: Reynolds Metals Company, Richmond, Va.

[21] Appl. No.: 697,306

[22] Filed: Aug. 22, 1996

[51] Int. Cl.[6] ..... B21D 19/04

[52] U.S. Cl. ..... 72/126; 72/117

[58] Field of Search ..... 72/117, 118, 126, 72/379.4

[56] References Cited

U.S. PATENT DOCUMENTS 5,121,621 6/1992 Ihly ..... 72/126

5,235,839 8/1993 Lee .

*Primary Examiner*—Lowell A. Larson

*Attorney, Agent, or Firm*—Robert C. Lyne, Jr.

[57] ABSTRACT

A flanging head assembly having a cluster of freely rotatable spin flanging rollers includes a stop ring against which the flange hits during the final flange forming stages to limit the flange to a specific diameter. To prevent the flange from entering the crack formed between the rotating roller and the stationary stop ring, there is provided a step spacing the stop ring surface from the roller forming surface. In a preferred embodiment, the step is axially forwardly spaced from the trailing end of the flange forming surfaces and intersects a conical surface extending radially inwardly beneath the flange forming surface. This conical surface contacts unsupported flange portions between the flanging rollers to limit the degree of elastic sagging of these portions. The intersection between this conical surface with the step also supports the sagging flange portions without inducing permanent flange deformation.

8 Claims, 4 Drawing Sheets

STOP RING IN APPARATUS FOR FLANGING CONTAINERS

TECHNICAL FIELD

The present invention relates generally to mechanisms for flanging an open end of a metal can or other container and, more particularly, to a spinning flanging head co-acting with a stationary stop ring to control and flange the open end.

BACKGROUND ART

Metal cans or containers, such as aluminum cans to contain beverages, are commonly manufactured by drawing and ironing a circular metal blank into a cylindrical can body having a side wall and a bottom wall. Such cans are then fed into necking and flanging apparatus by transfer or star wheels. Each can enters one of a number of stations in a necking turret undergoing rotational movement which is synchronous with the continued movement of the cans in the star wheel. During this rotational movement, the peripheral edge portion of the can side wall is formed by annular die members or spin forming members to form a neck of reduced diameter at the open end of the can. The necked cans are then transferred via transfer wheels to a flanging turret where the open edge of the can is flanged into a radially outward directed flange suitable for later receiving a can end in a known manner. The arrangement of drawing and ironing machines for forming the can bodies, and machines containing necking and flanging turrets are well known in the art.

A plurality of flanging heads are typically circumferentially spaced at the periphery of the flanging turret. Each flanging head has plural flanging rollers or spinners freely rotatably supported about their respective longitudinal axes in a central housing or cage. The cage is rotatable about its central longitudinal axis so that the flanging rollers revolve therearound in planetary relationship during flanging. Each flanging head typically includes an outer housing formed with a mounting flange adapted to be bolted to a mounting disk attached to the flanging turret, as is well known. The central housing containing the flanging rollers is rotatably disposed in the outer housing with ball bearings. A splined shaft projecting rearwardly from the outer housing is attached to the central housing to impart rotational movement about the central longitudinal axis via meshing contact with gearing disposed within the flanging turret. This arrangement is described in U.S. Pat. No. 5,235,839, issued Aug. 17, 1993 to Harry W. Lee, Jr. et al., entitled "Apparatus for Flanging Containers", assigned to Reynolds Metals Company, Richmond, Va., the Assignee of the present invention, the disclosure of which is hereby incorporated by reference herein in its entirety.

More specifically, the front of the flanging head is defined by a stop ring 100 (depicted in prior art FIG. 3 both herein and in the '839 patent) bolted to the outer housing. A retainer plate sandwiched between the stop ring 100 and ball bearing elements assists in maintaining the flange forming surface 120 of each flanging roller 140 in operative alignment with the stop surfaces 160 on the stop ring 100. As the flanging heads rotate, the marginal necked portion 180 of the can is advanced into contact with the rotating cluster of flanging rollers 140. Since the can does not rotate, contact between the marginal end 180 with the revolving rollers 140 induces free rotation of each roller which results in spinning contact and flange formation as the open end of the can contacts the progressively larger diameter portions 200 of each roller. These progressively larger diameter portions 200 cause corresponding enlargement of the can end and deflection of the metal into a flange 220 extending approximately perpendicular to the longitudinal axis of the can.

As the formed flange 220 is in its final forming stages during final camming movement of the can against the rotating rollers 140, the flange end contacts the stop surfaces 160 of the stationary stop ring 100, whose purpose is to stop the flange 220 at a specific preselected diameter so that the flange has the same width along all sides of the can. In practice, however, the annular flange 220 usually strikes one side of the surface 160 before it hits all sides. When this happens, it usually takes only a small additional force to disadvantageously force the flange into the crack 240 formed between the rotating roller 140 and the stationary stop ring 100. When this occurs, the can is ruined and must be scrapped, since the metal forced into the crack 240 forms a sharp vertical ear on the flange 220.

To avoid the foregoing problem, improved stop ring configurations are disclosed in our prior '839 patent. To prevent the flange from entering the crack formed between the rotating roller and the stationary stop ring, the '839 patent teaches the provision of a step spacing the stop ring surface from the roller forming surface. In this manner, as the terminal edge of the flange slides around the flanging roller during final forming, it will pass over the crack and across the step to lodge in a corner formed between the step and stop ring surface. In a preferred embodiment in the, '839 patent, the step is a conical surface extending from the stop ring surface in a direction away from the can bottom. This conical surface extends radially inwardly a sufficient distance to contact unsupported flange portions between the flanging rollers to limit the degree of elastic sagging of these portions. The spinners to not have to lift the flange as far to return it into contact with the stop ring corners. The inclined surface extends radially inwardly a sufficient extent to contact the sagging flange portions and also serves to prevent bending the edge of the flange back towards the closed end of the can which would disadvantageously tend to produce a flange that is grossly curved towards the closed end.

The aforementioned can flanging process typically requires about 60 to 65 pounds of axial loading to force the edge of the can against the stop ring surface hard enough to produce a uniform flange width. This force must be counterbalanced by the force of the five spinners acting on the can flange and by contact with the stop ring surfaces. This 60–65 pound axial force loading is split between the contact with the spinners and the contact with the stop ring surface. The amount of force on the spinners is proportional to the flange deflection in between the spinners.

The existing design disclosed in the '839 patent requires the flange to be deflected into an inverted shape in order to produce any significant force on the flange. Since the flange is supported by the conical surface and stop ring surface at a radially outwardmost portion-thereof, i.e. where the flange contacts the corner formed between the stop ring surface and the inclined surface, undesirable permanent deformation of the flange occurs with unacceptable frequency and, due to the fact that each can flange is not identical in strength, thickness, yield point, and other characteristics, there results permanent deformation of the can flanges into a variety of different flange shapes ranging from unacceptable high flange angles and rolled over flange angles to an acceptable flat flange angle. Therefore, a problem is encountered in relation to the difficulty in consistently producing cans with flat flange angles on a wide variety of can flanges having slightly different characteristics, as well as producing a flat flange angle along the entire circumferential periphery in a single can being produced.

DISCLOSURE OF THE INVENTION

It is accordingly one object of the present invention to prevent tearing of a can flange during flange formation.

Another object of the invention is to prevent undesirable formation of sharp vertical ears in a can flange, during flange forming, with only slight modification to existing flanging head assemblies.

Yet a further object is to prevent tearing of a can flange by preventing the flange from entering the crack formed between the rotating spinner and the stationary stop ring found in flanging head assemblies.

Still a further object is to uniformly produce can flanges having flat flange angles with acceptable flange width characteristics.

Another object is to produce can flanges having acceptable width and shape characteristics without inducing permanent deformation through contact of the flange with the stop ring.

The present invention is directed to improvements in flanging head assemblies for producing a peripheral flange on a free edge portion of a can or other container having a cylindrical body. The flanging head assembly is adapted to be mounted at the periphery of a flanging turret, and the cans to be flanged are typically conveyed by a star wheel along a path of movement which is parallel to and spaced from the path of movement of the flanging head assembly. A camming mechanism directs the open end of the can into contact with the flanging head assembly, where the open end engages a cluster of flanging rollers producing a peripheral outwardly directed flange in the open end. Each flanging roller has profiled flange forming surfaces adapted to receive the free edge portion of the can and spin same in a radially outward direction during axial movement of the free edge portion toward and against progressively larger diameter portions of the forming surfaces. The flanging rollers are mounted within a housing in circumferentially spaced relationship about a central longitudinal axis thereof. The rollers are revolved about a central longitudinal axis to create spinning contact with the axially advancing free edge portion. A stop ring has a stop surface mounted adjacent the forming surfaces to contact the free edge of the flange as it moves off the forming surfaces, thereby limiting further advancing and defining the final diameter of the flange.

A step is formed in the stop ring to space the stop surface from the forming surfaces. The step enables the terminal end of the flange being formed to travel past an interface gap or crack between the flanging roller and stop ring and across the step to contact the stop surface and avoid being entrapped in the gap. In accordance with this invention, the step is spaced axially forwardly from the trailing end of the forming surface and extends radially inward from the stop surface a predetermined distance to intersect with an interface surface on the stop ring defining the interface gap with an opposing surface of the roller.

The portion of the flange in between the flanging rollers or spinners is unsupported and tends to relax elastically which allows the outside edge of the flange to move radially towards the center of the can. The interface surface which is preferably an inclined surface with respect to the stop surface, positively contacts the sagging flange portions to control the elastic movement of the unsupported flange between the spinners. Thus, as the unsupported flange rotates relatively back towards the spinner, the spinner does not have to lift the flange as far to get it back into the corner formed at the intersection of the step with the stop surface, due to the fact that the interface surface minimizes forward sagging of the unsupported flange between the spinners. In addition, due to the intersection of the step with the interface surface at a radially inward spaced location from the stop surface, the flange is supported along the radially inward spaced intersection. Advantageously, by shifting the support point for the flange to a position closer to the can longitudinal axis, the necessary axial load can be applied to the can without producing permanent deformation of the outermost flange edge, thereby minimizing the frequency of forming flanges with either unacceptedly high flange angles or rolled over angles.

The step and interface surface of the stop ring, in longitudinal sectional view, preferably form an obtuse angle with each other. The intersection between the step is preferably located radially inwardly of the trailing end of the forming surface. In this manner, the flange portions between these spinners are supported in as radial close proximity to the can longitudinal axis as possible without affecting the ability of the interface surface to support the sagging flange portions between adjacent spinners.

The step and stop surface may be perpendicular to each other. The interface surface, which intersects a radially inwardmost point of the step, is inclined with respect to the stop surface to produce the aforementioned support characteristics. By forming the step to have a radial extent of less than about 0.025 inch, and preferably within the range of 0.005–0.015 inch, it has been discovered through extensive experimentation that the formation of desirable flat flange angles can be optimized.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and that several details are capable of modifications in various obvious respects, all without departing from the present invention. Accordingly, the drawing and description are to be regarded to be illustrative in nature, and not as restrictive.

BEST MODE FOR CARRYING OUT THE INVENTION

Figure 1:
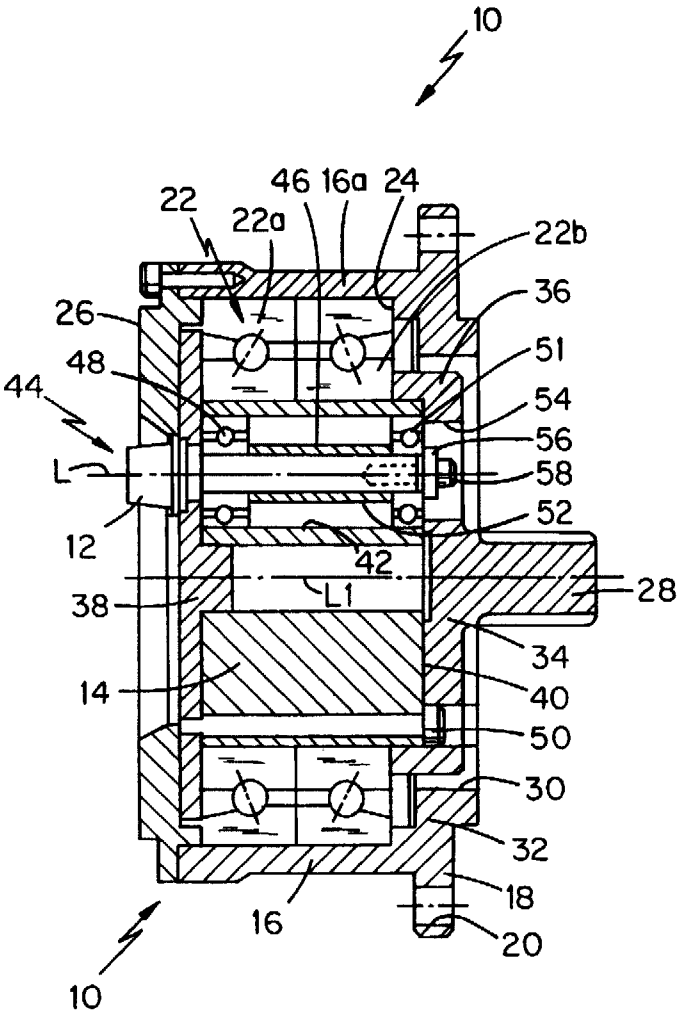
FIG. 1 is a cross-sectional side view of a flanging head assembly taken along the line 1—1 of FIG. 2.
Figure 3:
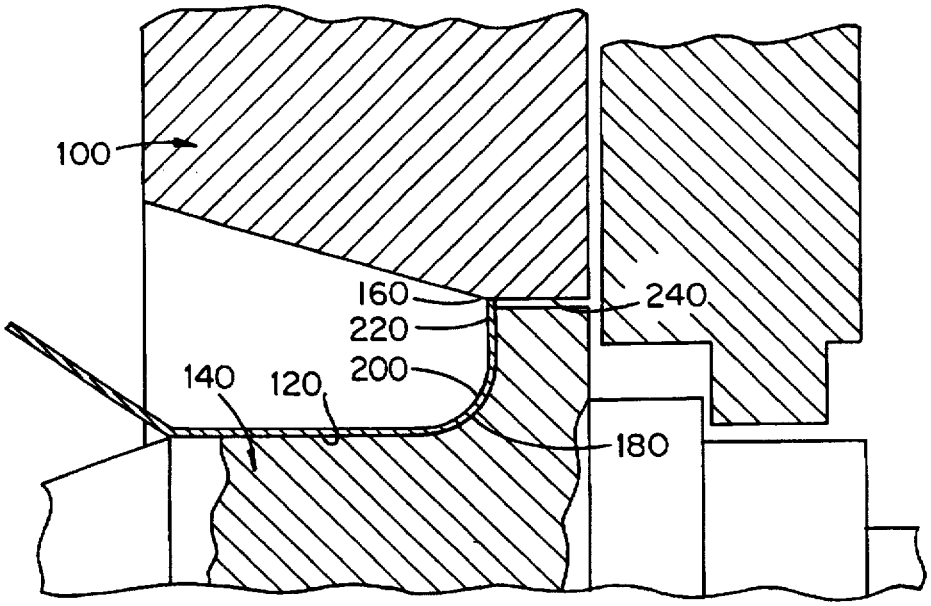
Figure 3 PRIOR ART
FIG. 3 is an enlarged cross-sectional view of the interface typically formed between each of the spin flanging rollers with the surrounding stop ring in accordance with the prior art.

FIG. 1 is an illustration of one of flanging heads 10 of the invention which are circumferentially spaced around the periphery of the flanging turret (not shown). Each flanging head 10 comprises a plurality (e.g., five) of circumferentially spaced reforming spinners (spin flanging rollers) 12 each supported, in a freely rotatable manner about its longitudinal axis L, in a central housing or cage 14 rotatable about a central longitudinal axis L1 around which the spinners are rotated in planetary relationship during flanging. More specifically, flanging head 10 includes a cylindrical outer housing 16 formed with a mounting disk (not shown) attached to the flanging turret as is well known. The central housing 14 is rotatably disposed in outer housing 16 by means of ball bearings 22. The outer race **22*a* of bearings 22 is axially fixed within housing 16 by rear contact with a shoulder 24 projecting radially inward from the cylindrical side wall 16*a* and forward contact with a stop ring 26 described in more detail below. A splined shaft 28 projecting rearwardly from an opening 30 formed in the bottom wall 32 of the cylindrical outer housing 16 is formed with an enlarged portion (driven member) 34 having a peripheral upstanding wall 36 radially inwardly spaced from and coplanar with the shoulder 24 to engage the rear surface of the inner race 22*b*. A retainer plate 38 sandwiched between the front end of the inner race 22*b* and the stop ring 26 prevents forward axial movement of the inner race. This retainer 38 also engages the front end surface of the central housing 14 to retain same in the outer housing 16 while the enlarged portion 34 of the splined shaft 28 engages the rear surface 40 of the central housing to assist in preventing rearward axial movement thereof. Bolts 50 extend through the enlarged portion 34, central housing 14 and the retainer plate 38 to secure these parts together within the outer housing 16**.

The central housing 14 is further formed with circumferentially spaced axial through-bores 42 each adapted to receive a reforming spinner assembly 44 therein. The individual spinner assemblies 44 are each formed with an elongate mounting shaft 46 projecting rearwardly into the through-bore 42 for rotational mounting therein via front and rear ball bearings 48 and 51 disposed at opposite ends of the through bore. The bearings 48, 51 are spaced from each other with a spacer 52. The through bores 42 are in axial alignment with apertures 54 formed in the enlarged portion 34 of the shaft 28. These apertures 54 receive a clamp washer 56 and bolt 58 secured to the rear face of the spinner mounting shaft 46 to retain the shaft and thereby the flanging roller 12, projecting forwardly from the shaft, for rotation in the through-bore 42 about its axis L.

Figure 2:
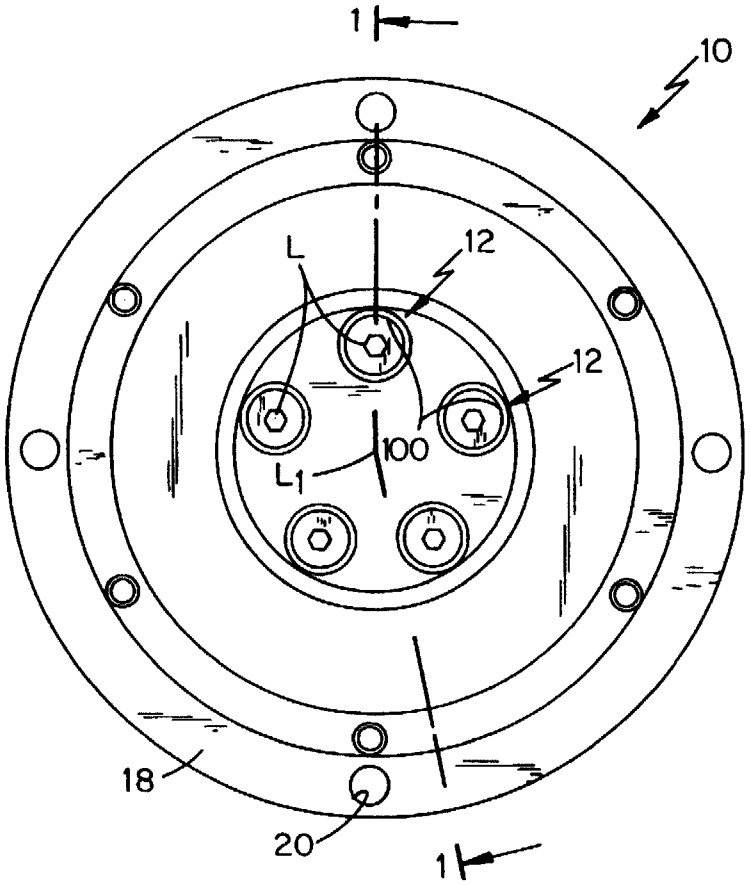
FIG. 2 is a front end view of the head assembly of FIG. 1.

Known gearing means (not shown) is provided within the flanging turret in meshing contact with the center splined shaft 28 to rotate the inner assembly 34, 14, 38 and thereby the individual spinner assemblies 44 about central axis L1 (FIG. 2).

As the inner assembly rotates, the marginal necked portion 60 (FIG. 4) of the can 62 is cammed into contact with the rotating cluster of rotating spinners 12 which are depicted in FIG. 2. Since the can does not rotate contact between the marginal end 60 with the rotating spinners 12 induces free rotation of each spinner which results in flange formation as the open end of the can 62 contacts the progressively larger diameter forming surface portions 66 of the rotating spinner. These progressively larger diameter portions 66 cause corresponding enlargement of the can end and deflection of the metal into a flange 68 extending approximately perpendicular to the longitudinal axis of the can 62.

Figure 4:
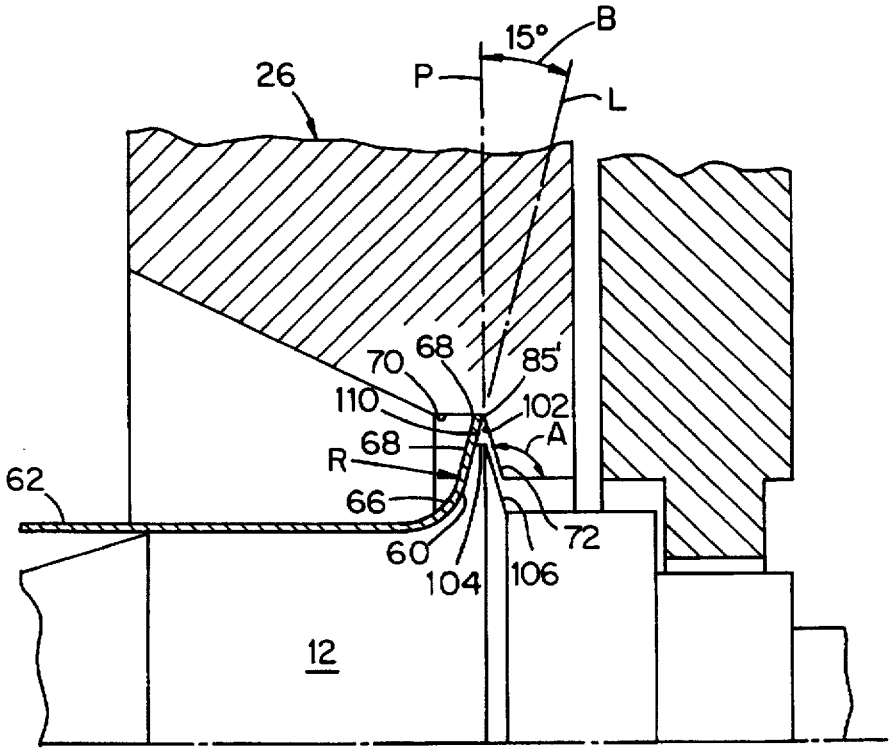
Figure 4 PRIOR ART
FIG. 4 is an enlarged cross-sectional view of a preferred embodiment disclosed in the aforesaid U.S. Pat. No. 5,235,839.
Figure 5:
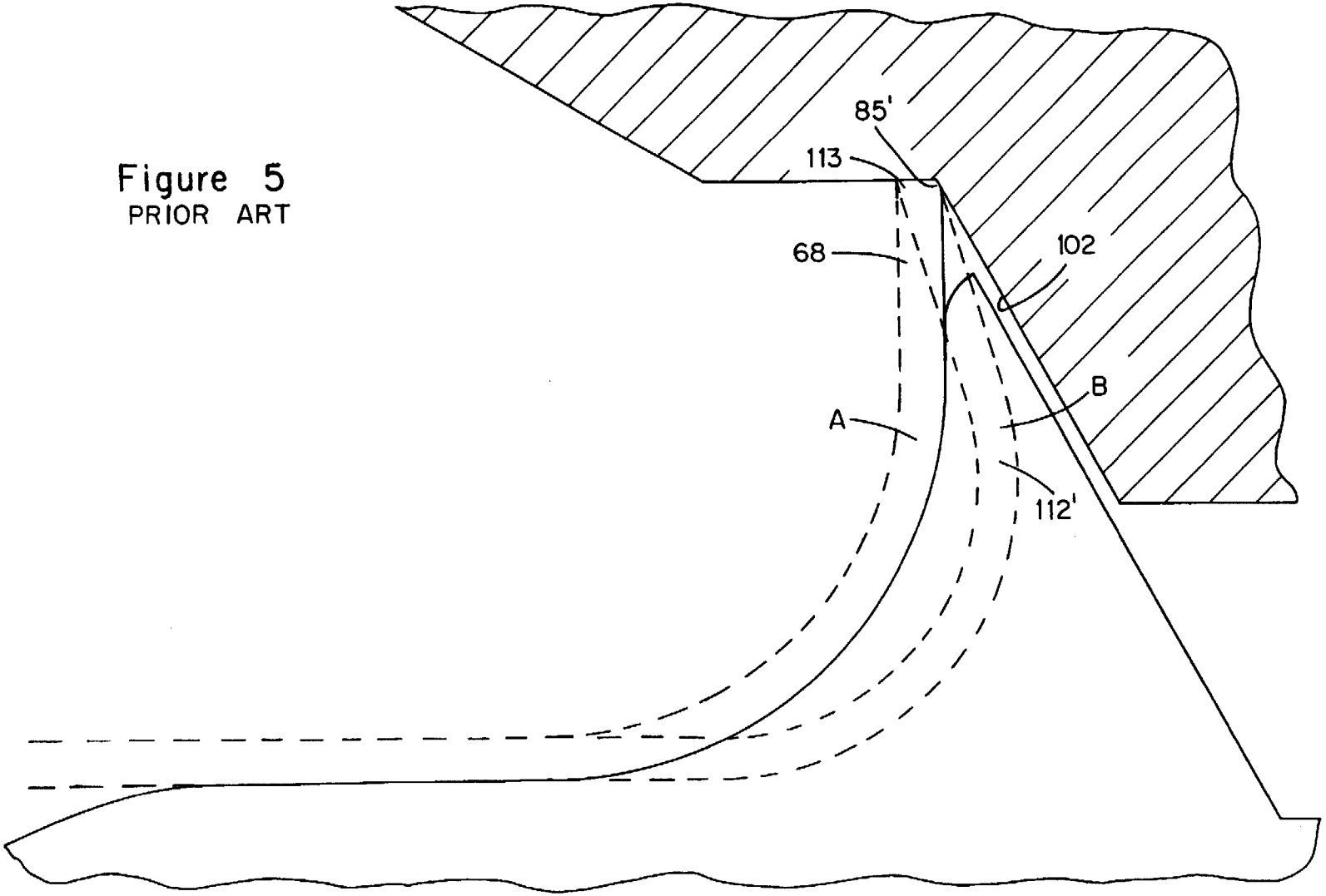
Figure 5 PRIOR ART
FIG. 5 is a view similar to FIG. 4, depicting the flange both as supported on the spinner as well as in elastically relaxed condition as a result of axial loading during flanging between adjacent spinners.

With reference to FIGS. 4 and 5, the step spacing the stop surface 70 from the crack 72 is formed as an inclined surface 102. (e.g., a conical section) extending radially inwardly from a point of intersection 85' with stop surface 70, at a predetermined angle A, in the direction of the open end of the can (i.e., in the direction away from the can bottom). The sagging portions 112' of the unsupported flange are now supported by surface 102 in between the spinners when it sags forwardly. Since surface 102 provides positive support for the sagging portions 112', it prevents the flange from sagging further forward. Advantageously, therefore, the spinners do not have to lift the flange as far to return it into contact with corner 85'.

With reference to FIG. 5, sagging portions 112' are depicted in phantom line between adjacent spinners wherein it can be seen that support for the sagging portions occurs along the radially outwardmost edge of the flange tips 113 where they are pressed against covers 85'. As a result of cantilevering principles, this radially outwardmost form of flange support induces undesirable permanent flange deformation by creating support forces that exceed the elastic range of the flange under nominal axial loads of 60 to 65 pounds which normally occur within flanging apparatus.

Figure 6:
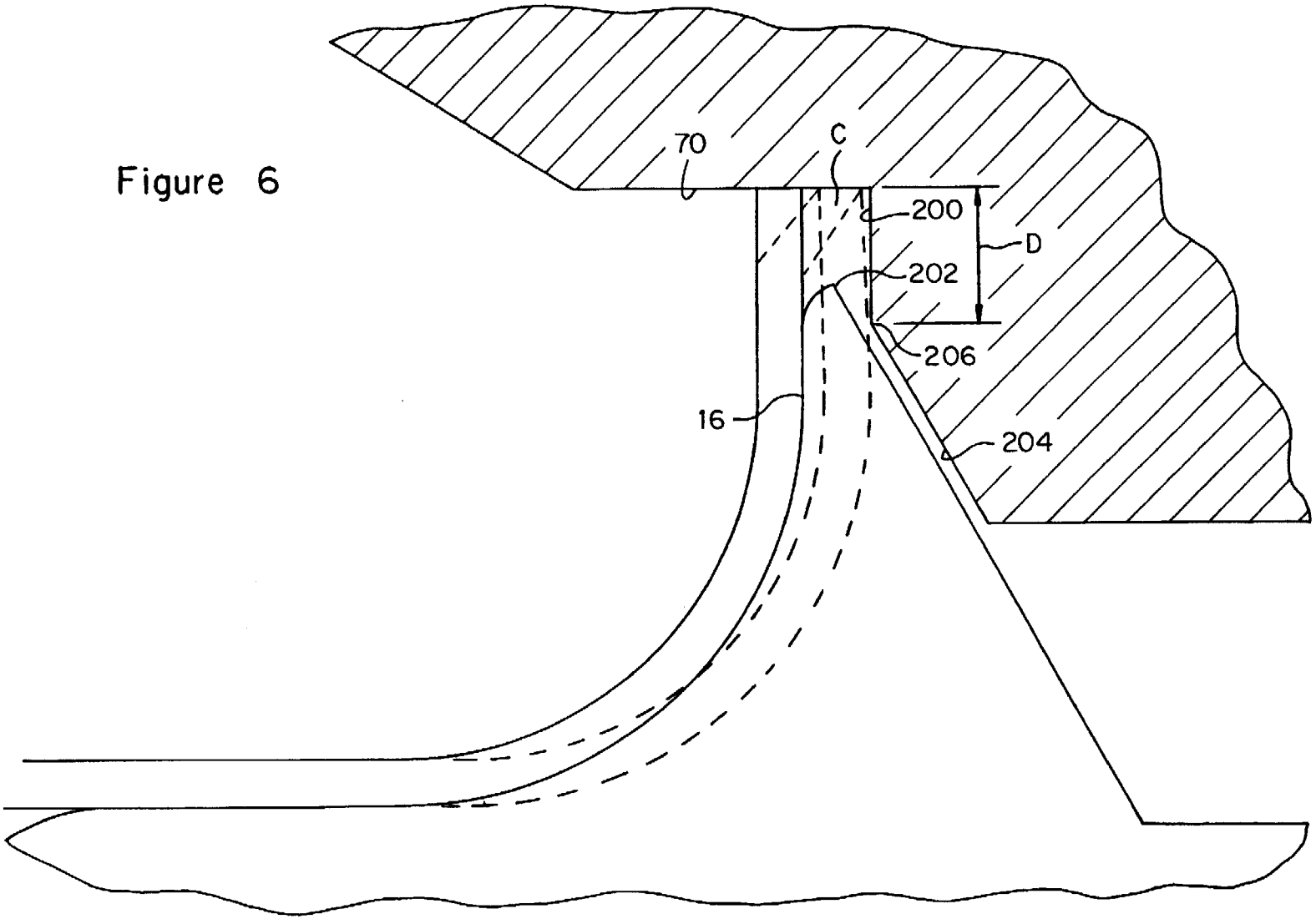
FIG. 6 is an enlarged cross-sectional view of a preferred embodiment of the present invention.

To overcome this problem, in the preferred embodiment of the invention depicted in FIG. 6, a step 200 is formed in an axially forwardly spaced relationship to the trailing end 202 of the forming surface 66 and extends radially inward from the stop surface 70 a predetermined distance D to intersect with an inclined surface 204 (e.g. a conical section) extending radially inwardly from a point of intersection 206 with the step surface 200, in the direction of the open end of the can (i.e., in the direction away from the can bottom). An important benefit of the preferred embodiment is that the sagging portions 112' of the unsupported flange are now supported by the inclined surface 204 (in a manner similar to surface 102) in between the spinners when it sags forwardly. Advantageously, however, the predominant support point for the sagging portions 112' occurs at the intersection 206 which is radially inwardly spaced by step distance D from the stop surface 70. By locating the supporting intersection 206 for the sagging portions 112' in this unique radially inwardly spaced manner from the stop surface 70, there is advantageously maintained lower stress levels in the flange within the elastic range so that flat flange angles at acceptable widths tend to be more uniformly produced.

With the prior invention depicted in FIG. 4, the stop surface 70 at which the load was distributed across the flange edge 68 is spaced approximately 0.092 inch from the container neck 62. By forming the step 200 to have a distance D of, for example, 0.020 inch, the sagging portions of the flange are now supported at a distance of 0.072 (i.e., 0.092 less 0.020) inch from the neck wall 62 instead of 0.092 inch. The resulting deflection of the flange will be proportionally less as the cube of this distance. Advantageously, this means that at the intersection 206 between the step 200 and the inclined surface 204 along which the sagging portions 112' are supported, the deflection will be about 47% of the deflection achieved at the same load applied in the prior FIG. 4 embodiment which advantageously does not produce any permanent deformation in the flange shape. At a step 200 of 0.015 inch, the deflection will be only 58%.

Tests were conducted with the stop ring design depicted in FIG. 5 and with the stop ring of the invention depicted in FIG. 6 under certain operating conditions. For example, spin flow manufactured cans made with the spin flow necking machine depicted in Applicant's prior U.S. Pat. No. 5,282,375 were used to make cans having a plug diameter of about 2.045–2.050 inch and a flange of between 0.065–0.085 inch. These spin flow manufactured cans were then flanged with a flanging apparatus as described hereinabove at various "pin heights". As used in the specification, "pin height" is the distance from the base pad to the trailing end of the forming surface of the rotating spinners. As set forth in Table 1, pin heights from 4.80–4.78 inch were tested under an axial load of 62 pounds. The pin height was gradually reduced in 0.002 inch increments and four cans were flanged at each setting.

TABLE 1

| | STANDARD STOP RING | | MODIFIED STOP RING | |
|---|---|---|---|---|
| BASE PIN HT. | F. WIDTH | (3) ROLLOVER | F. WIDTH | (5) ROLLOVER |
| 4.800 | 75–83 | 0% | 77–89 | 0% |
| 4.800 | 74–87 | 0% | 80–89 | 0% |
| 4.800 | 79–85 | 0% | 78–88 | 0% |
| 4.800 | 77–85 | 0% | 75–82 | 0% |
| 4.798 | 75–84 | 0% | 80–88 | 0% |
| 4.798 | 74–80 | 0% | 80–89 | 0% |
| 4.798 | 75–84 | 0% | 85–90 | 0% |
| 4.798 | 72–85 | 0% | 81–90 | 0% |
| 4.796 | 77–87 | 0% | 77–89 | 0% |
| 4.796 | 74–86 | 0% | 78–85 | 0% |
| 4.796 | 74–87 | 0% | 82–91 | 0% |
| 4.796 | 78–89 | 0% | 84–90 | 0% |
| 4.794 | 76–86 | 0% | 84–90 | 0% |
| 4.794 | 75–85 | 0% | 85–91 | 0% |
| 4.794 | 77–87 | 0% | 80–91 | 0% |
| 4.794 | 77–87 | 0% | 83–90 | 0% |
| 4.792 | 78–88 | 10% | 85–91 | 10% |
| 4.792 | 82–89 | 0% | 83–91 | 0% |
| 4.792 | 81–89 | 0% | 87–91 | 0% |
| 4.792 | 78–89 | 10% | 84–91 | 0% |
| 4.790 | 84–89 | 10% | 86–91 | 10% |
| 4.790 | 83–90 | 10% | 89–91 | 0% |
| 4.790 | 78–91 | 20% | 85–91 | 10% |
| 4.790 | 84–91 | 10% | 86–91 | 10% |
| 4.788 | 81–91 | 10% | 89–91 | 40% |
| 4.788 | 80–91 | 20% | 89–91 | 40% |
| 4.788 | 81–91 | 30% | 88–91 | 30% |
| 4.788 | 87–91 | 30% | 88–91 | 40% |
| 4.786 | 85–91 | 70% | 85–91 | 90% |
| 4.786 | 84–91 | 40% | 88–91 | 50% |
| 4.786 | 87–91 | 0% | 89–90 | 50% |
| 4.786 | 82–91 | 20% | 89–91 | 50% |
| 4.784 | 85–91 | 20% | 90–93 | 70% |
| 4.784 | 85–92 | 60% | 90–93 | 80% |
| 4.784 | 87–91 | 50% | 90–93 | 80% |
| 4.784 | 88–91 | 40% | 90–95 | 70% |
| 4.782 | 85–91 | 90% | ALL | |
| 4.782 | 88–91 | 100% | — | |
| 4.782 | 83–91 | 70% | TORN | |
| 4.782 | 87–91 | 100% | | |
| 4.780 | 89–91 | 100% | | |
| 4.780 | TORN | | | |
| 4.780 | 89–91 | 100% | | |
| 4.780 | TORN | | | |

The percentage values set forth in columns 3 and 5 of Table 1 refer to the circumferential extent of which the observed flange was rolled over. At a pin setting of 4.80 inch, for example, flange width is not very uniform although no rollovers were detected. As the pin setting is reduced, i.e. greater application of force is applied against the flange by the spinners, flange width increases and tends to become more uniform.

At a pin setting of about 4.790 inch, flange width becomes yet more uniform (in a preferred flange width range of 0.080–0.091 inch), however, with the stop ring design of FIG. 5, the flanges are being formed with approximately 10 to 20% rolled over circumference. At progressively lower pin heights (e.g. 4.790–4.786) although progressively better flange widths are obtained, the frequency of unacceptable rollovers also increases.

In comparison, the modified stop ring of the present invention depicted in FIG. 6 advantageously results in satisfactory flange widths of about 0.083–0.091 inch with virtually no rollovers.

As a result of extensive experimentation, the step 200 is preferably formed to be of constant width in the range of about 0.005–0.015 inch when the distance between the neck 62 and the stop surface 70 is about 0.092 inch. It has been discovered that a step greater than 0.025 inch is likely to cause 'hooking' of the flange which is depicted by a reference character C in FIG. 6. "Hooking" is believed to occur as a result of the permanent deformation of the flange due to excessive forward spacing of the step 200 from the trailing end 202 of the spinner.

From the foregoing experimentation, it has been further discovered that the selection of an appropriately sized step can be somewhat dependent on the distance between the spacing of the base pad to the spinflow necking tooling during the necking in of the container open end in the aforementioned spinflow necking apparatus. For example, at greater distances between the base pad and spin flow necking tooling, smaller size flanges tend to be formed due to less metal available in the container open end for necking in to acceptable plug diameter. The nominal dimensions of these input flanges into the flanging stations of the present invention and the manner in which these input flanges are flanged into final length and shape can depend on the size of the step. Stated differently, the base pad height setting used in the spinflow necking stations may be a contributing factor in selecting the proper step width in the stepped stop ring of the present invention in order to select the proper pin height to insure acceptable final flange widths with minimal roll over, hooking or unacceptable high flange angles.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A flanging head assembly for forming a peripheral outwardly directed flange in a free edge portion of a can having a cylindrical body, comprising a plurality of flanging rollers having profiled flange forming surfaces adapted to receive said free edge portion and spin same in a radially outward direction during relative axial movement of said free edge portion toward and against progressively larger diameter portions of said forming surfaces; housing means for mounting said flanging rollers about a central longitudinal axis thereof; means for revolving said rollers about said central longitudinal axis to create spinning contact with said relatively axially advancing free edge portion, and a stop ring having a stop surface mounted adjacent a trailing end of said forming surfaces to contact the free edge of the flange as it moves off the forming surfaces to limit the diameter of the flange, the improvement comprising a step formed in the stop ring which spaces the stop surface from the forming surfaces to enable the terminal end of the flange being formed to travel past an interface gap between the roller and stop ring and across the step to contact the stop surface and avoid movement of a portion of the terminal end of flange into the gap, said step is spaced axially forwardly from the trailing end of the forming surface and extends radially inward from the stop surface a predetermined distance to intersect with a surface on the stop ring defining said interface gap with the roller.

2. The assembly of claim 1, wherein said predetermined distance is less than about 0.025 inch.

3. The assembly of claim 1, wherein said predetermined distance is between about 0.005–0.015 inch.

4. The assembly of claim 1, wherein said step and said surface forming the interface gap, in longitudinal sectional view, form an obtuse angle with each other.

5. The assembly of claim 1, wherein the intersection between said step and said surface forming the interface gap is located radially inwardly of the trailing end of the forming surface.

6. The assembly of claim 1, wherein said step is generally perpendicular to the stop surface and said surface forming said interface gap intersects a radially inwardmost point of said step and is inclined with respect to the stop surface.

7. The assembly of claim 6, wherein the portions of the flange between adjacent rollers tend to relax elastically and sag forwardly and radially inward toward the center axis of the can, said inclined surface extending to contact said sagging flange portions and thereby control the distance through which the flange forming surfaces of the rollers have to lift the sagging portions back onto the step towards the stop surface, and the intersection of said step with said inclined surface acting to provide support for the radially outermost portions of the flange without inducing permanent deformation of the flange.

8. The assembly of claim 1, wherein said predetermined distance is in an optimum range of about 0.010–0.012 inch.

* * * * *